United States Patent [19]

Beney et al.

[11] Patent Number: 5,044,611

[45] Date of Patent: Sep. 3, 1991

[54] AUTOMATIC INSTALLATION FOR THE FORMING AND THERMAL TREATMENT OF CIRCULAR PIECES

[75] Inventors: Maurice Beney, Montreuil; Jean Fromentin, Courcouronnes, both of France

[73] Assignee: Stein Heurtey, Ris Orangis, France

[21] Appl. No.: 354,239

[22] Filed: May 19, 1989

[51] Int. Cl.[5] ..... C21D 9/54

[52] U.S. Cl. ..... 266/105; 266/259

[58] Field of Search ..... 266/78, 99, 103, 105, 266/259

[56] References Cited

FOREIGN PATENT DOCUMENTS 3307041 5/1984 Fed. Rep. of Germany .
1598224 8/1970 France .
2593192 7/1987 France .
8605820 10/1986 World Int. Prop. O. .

OTHER PUBLICATIONS

English Abstract of WIPO included.
Copy of the French Search Report.

*Primary Examiner*—S. Kastler
*Attorney, Agent, or Firm*—Sandler, Greenblum & Bernstein

[57] ABSTRACT

An automatic installation for obtaining in large series circular pieces of small thickness, such as notably spring diaphragms, for the automobile industry, in forming, swaging, quenching, tempering and peripheral tempering stations, these various working treatment stations being placed one after the other so that the pieces to be worked be successively transferred from one station to another, characterized in that:

it includes a machine allowing realizing automatically and in series a forming operation by hot swaging and quenching of spring diaphragms or circular pieces;

each entirely automated working station includes a press provided with individual heating means, said working stations receiving the pieces one by one from said automatic machine, with the assistance of transfer means withdrawing one by one the pieces to be treated from the quenching stations of the automatic machine for transferring them successively thereafter and one by one to each of the working stations;

means are provided for blowing into each working station cold air in the central portion of the piece placed on the corresponding press, so as to maintain the temperature of this central portion at a value less than the temperature of the periphery, during the peripheral tempering treatments of the latter;

it includes a final cooling station on which the piece incoming from the preceding stations is subjected to a cooling via blown cold air and;

means are provided for storing the treated pieces by stacking them so as to ensure thereafter the discharge of the treated pieces conditioned in stacks.

12 Claims, 5 Drawing Sheets

AUTOMATIC INSTALLATION FOR THE FORMING AND THERMAL TREATMENT OF CIRCULAR PIECES

BACKGROUND OF THE INVENTION

1. Field of the Invention

The present invention relates to an automatic installation involving a prequenching heating, forming, quenching, progressive tempering and finally cooling system for the manufacture in large quantities of pieces which exhibit particular characteristics of strength, flexibility and hardness. This installation is more particularly adapted to the production of circular pieces of small thickness, notably disk springs, saw blades and more particularly spring diaphragms for the automobile industry.

2. Description of Related Art

In recent years, spring diaphragms have been substituted for the traditional maneuvering levers and multiple helical springs placed on the periphery of the automobile vehicle clutching mechanisms. It is known that the spring diaphragm is a steel disk which is deeply serrated in its center and which, when at rest, has a regular conical shape. Prior to its treatment, this piece which is made from spring steel has to be in the annealed state and has a homogeneous metallurgical structure. The treatments to which it is thereafter subjected consist in a heating operation followed by quenching. It may also be necessary to subject the piece to a radially progressive tempering so that the diaphragm spring in the finished state exhibits radially progressive temper and hardness characteristics. The present invention is concerned with providing an automatic installation meeting this requirement on a continuous basis during the whole treatment, namely from the forming stage by hot swaging to the final cooling stage.

An automatic machine which produces clutch diaphragms via a cycle of hot swaging forming and quenching operations is already known. In this respect, one may refer to French Patent No. 1,598,224 which discloses an automatic machine including a heating enclosure containing a conveyor barrel with equidistant radial compartments opening at the periphery of said barrel. The enclosure is imparted with a step by step rotary motion in order to receive on the upstream side of the heating enclosure a cold piece which has to be introduced in an empty compartment of the barrel by charging and discharging means, and on the other hand to deliver to these last means a hot piece from the downstream side of said enclosure. The charging and discharging means operating upstream have means for feeding, one by one, pieces to be treated and stacked inside a feed magazine. Downstream a piece to be formed by hot swaging and quenching means cooperates with gripping and conveyor means conveying each finished piece into a receiving magazine.

Such a machine, while providing pieces swaged and quenched in a uniform manner, does not produce spring diaphragms exhibiting radially progressive temper and hardness characteristics.

In an attempt to solve the problem posed by the production of pieces, such as spring diaphragms presenting the hereabovementioned characteristics of variable temper and thickness, a thermomechanical treatment installation for a series of pieces in which the reheating device, the quenching press, the tempering device and the cooling device are placed immediately one after another, has been recently developed (WO-A-8 605 820). The temperature and duration of each treatment step is controlled in the system according to a preestablished program.

This prior device, however, does not allow controlling in each working station, and continuously, the temperature gradients in the treated pieces so as to obtain pieces having the radially progressive temper and hardness characteristics.

Consequently, the invention provides a device meeting such a requirement.

SUMMARY OF THE INVENTION

The object of the invention is an automatic installation for obtaining in large series, circular pieces of small thickness, such as spring diaphragms, for the automobile industry, in forming, swaging, quenching, tempering and peripheral tempering stations. These various working treatment stations are placed, one after the other, so that the pieces to be worked are successively transferred from one station to another. More particularly, the automatic installation of the invention includes:

a) a machine allowing automatically and in series a forming operation by hot swaging and quenching of spring diaphragms or circular pieces;

b) entirely automated working stations which include a press provided with individual heating means, said working stations receiving the pieces, one by one, from said automatic machine, with the assistance of transfer means withdrawing one by one the pieces to be treated from the quenching stations of the automatic machine for transferring them successively thereafter and one by one to each of the working stations;

c) means for blowing into each working station cold air in the central portion of the piece placed on the corresponding press, so as to maintain the temperature of this central portion at a value less than the temperature of the periphery, during the peripheral tempering treatments of the latter;

d) a final cooling station on which the piece incoming from the preceding stations is subjected to cooling via blown cold air and;

e) means for storing the treated pieces by stacking them so as to ensure thereafter the discharge of the treated pieces conditioned in stacks.

According to one feature of the automatic installation, according to the present invention, a pretempering treatment is carried out in the first working station of said plurality of stations, and a series of peripheral tempering treatments is then carried out in the following successive working stations, the central portion of the treated piece being constantly cooled during these peripheral tempering operations.

As a preferred embodiment of the present invention, the pieces are extracted from the automatic swaging and quenching machine and transmitted, one by one, to the various working stations with the assistance of gripping arms including supports for receiving plates for the pieces, these arms being imparted on the one hand with a rotary motion and on the other hand with a translational motion with the assistance of a mobile beam system moved by jacks.

BRIEF DESCRIPTION OF DRAWINGS

Other features and advantages of the present invention will become more apparent from the following description made with reference to the accompanying drawings illustrating an embodiment thereof having no limiting character. In the drawings.

DETAILED DESCRIPTION OF THE INVENTION

Figure 1:
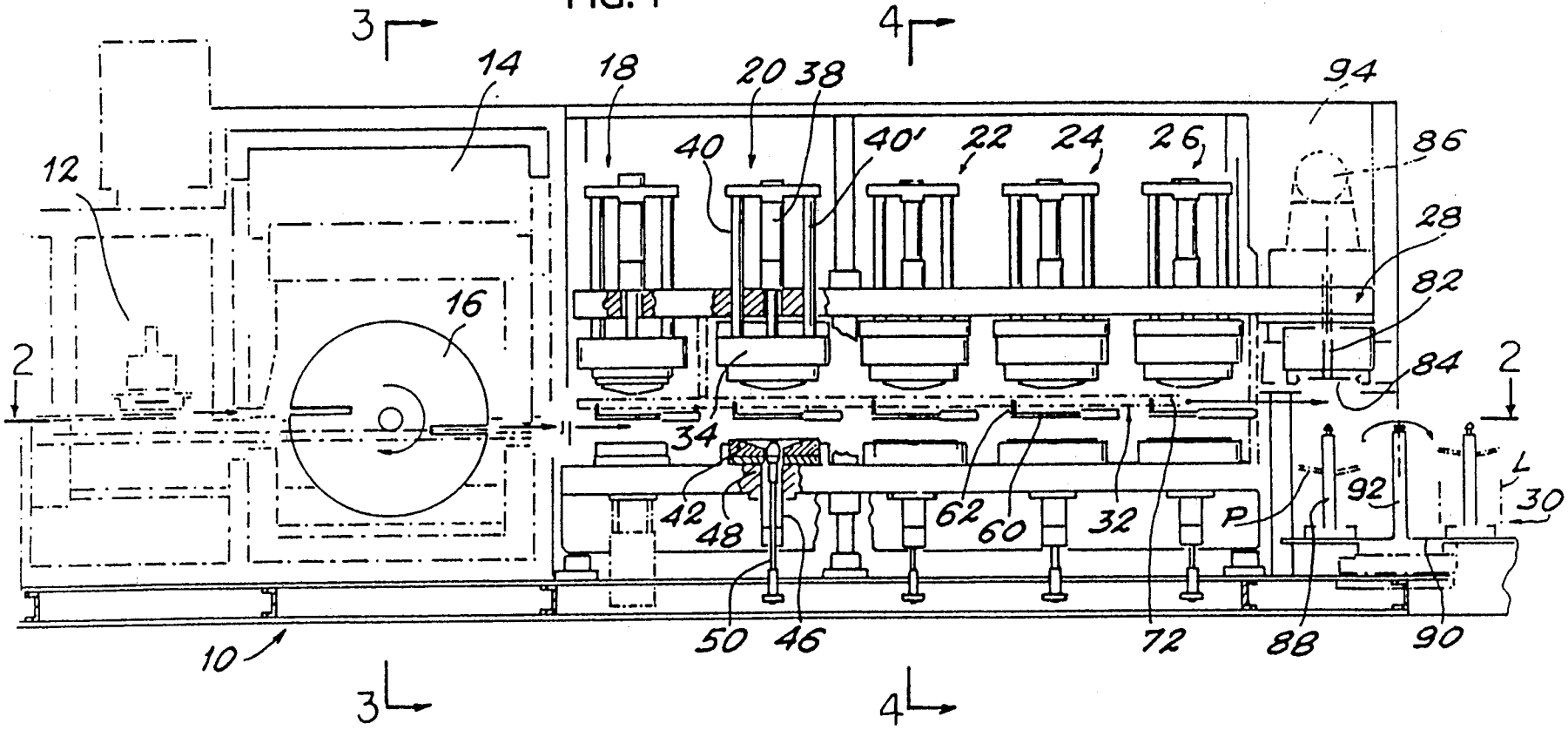
FIG. 1 is a side elevation and sectional view as per I—I of FIG. 2 of an embodiment of an automatic installation according to the invention.
Figure 2:
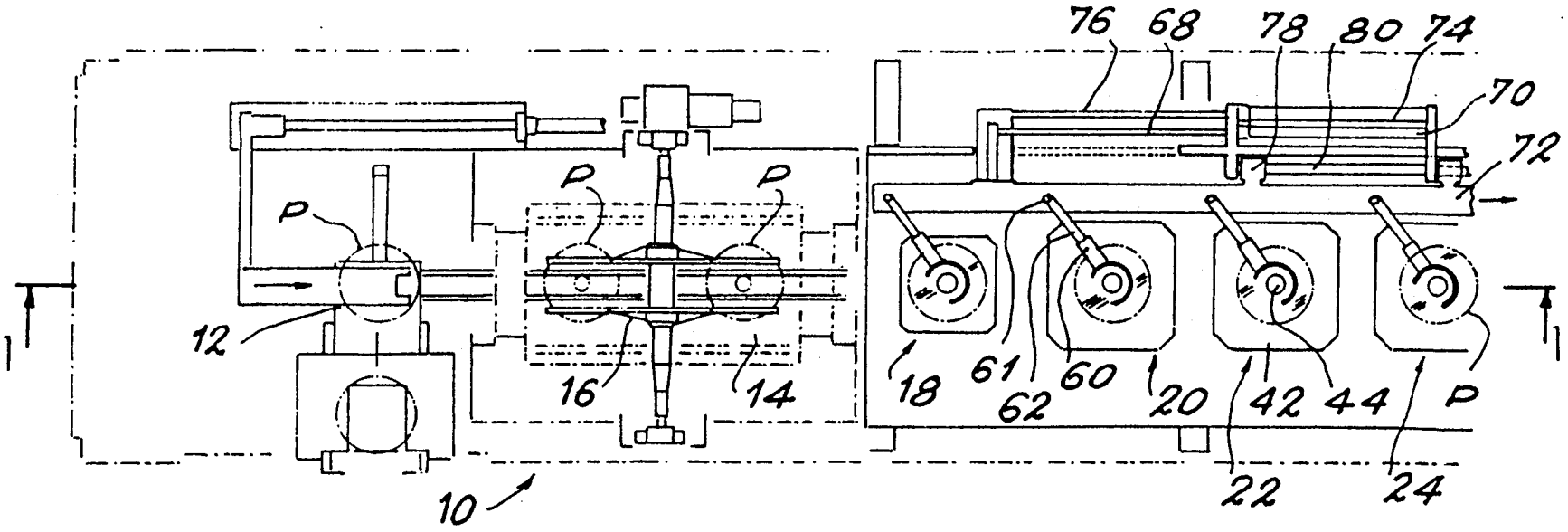
FIG. 2 is a sectional view along II—II of FIG. 1.

With reference to the drawings, one sees that the installation includes substantially the following sections:

1) An automatic machine for the swaging and quenching in series of circular pieces, and notably of spring diaphragms. This machine, designated generally by reference 10, is of the type disclosed in French Patent No. 1,598,224 and it includes means 12 for delivering the circular pieces one by one to a heating enclosure 14 where the pieces are admitted in the successive compartments of a barrel 16. This enclosure provides for the heating of the pieces which are then delivered, one by one, to a quenching station designated generally by reference 18. Since this part of the installation is made according to the indications appearing in French Patent No. 1,598,224, it will not be described in further detail.

2) A plurality of successive working stations to which the pieces P to be treated are delivered, one by one, in order to be subjected to a specific thermal treatment and which, in this embodiment, includes a pretempering station 20 and peripheral tempering stations 22, 24 and 26.

3) A cooling station 28 to which the pieces coming from the preceding successive stations are transmitted.

4) Receiving means for the storage and discharge of the treated pieces, designated generally by reference 30; and 5) Means 32 for transferring, one by one, the pieces P to be treated from one working station to another.

As explained hereinabove, the present invention successively carries out a hot swaging, forming, operation followed by quenching (stations 10 and 18), pretempering (station 20), then a peripheral tempering (stations 22, 24, 26) during which the pieces P, which are progressing successively inside the installation, are subjected to peripheral tempering with a cooling down of their central portion, and finally a rapid final cooling (station 28), prior to their conditioning in stacks, followed by their discharge (station 30).

Figure 7:
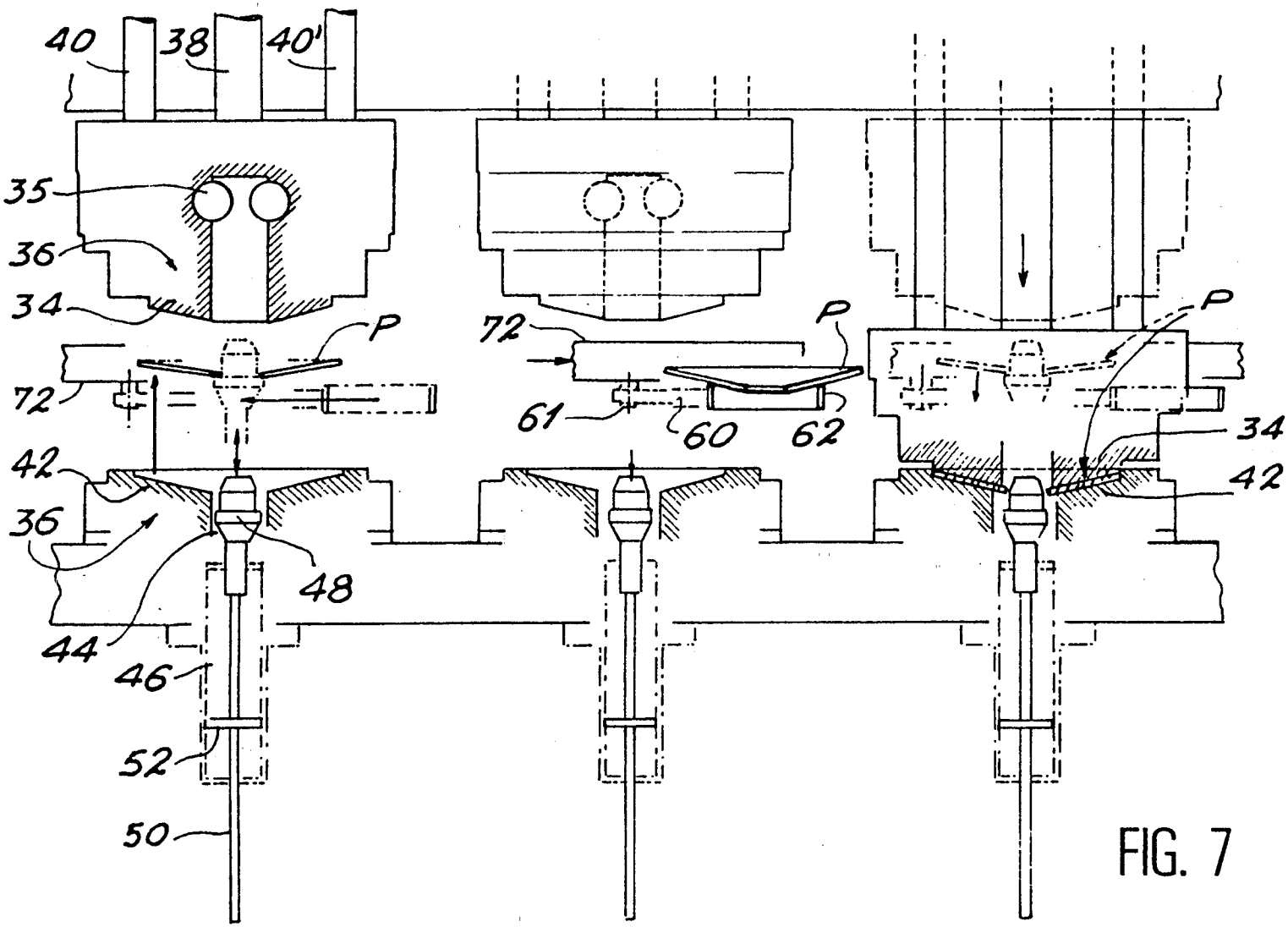
FIG. 7 is a view at a larger scale and in a section similar to that of FIG. 1 showing an embodiment of one of the installation working stations.

Each working station, such as 20, 22, 24 or 26 is in the form of a press (see FIG. 7), including a die 42 and a punch 34, each punch 34 and die 42 being provided with an individual heating means 35. The press tool can be displaced in a standard manner under the action of a jack 38 while being guided along columns 40, 40'. During the treatment, piece P is held clamped between punch 34 and die 42 which are formed with a bore 44 in their central portion. This bore 44 is connected to a duct 46 fed with cold air so as to ensure the cooling of the central portion of the piece positioned on die 42. The discharge of the cooling air is effected through channels formed in the press mobile table and extended outside the machine. An extractor 48 is mounted so as to be able to slide inside bore 44 under the action of a control rod 50 actuated by jack 47. As may be seen in FIGS. 4 and 7, the control rod 50 of each extractor 48 is provided with a circular disk 52 forming a shutter which separates the upper portion of duct 46 from duct 54 which provides for the supply of cold air in duct 46 when extractor 48 is in a high position. This feeding system has been shown in detail in FIG. 4. One sees that duct 54 is fed via a turbine 56. Due to this arrangement, cold air is supplied to the central bore 44 of punch 34 and die 42 of the press during the pretempering and peripheral tempering operations, and if necessary during the pretempering operation, when extractor 48 is in its low position, that is when the press is in the working position, thereby providing for a controlled cooling of the central portion of piece P. Disk 52 which forms a shutter for duct 46 interrupts the feeding with cold air of the central portion of die 42 and therefore the cooling down when extractor 48 is moved to its high position under the action of jack 47 when the press is open, so as to reach and grip piece P which has just been treated, in order to provide for its transfer to the following station as hereinafter described.

Figure 4:
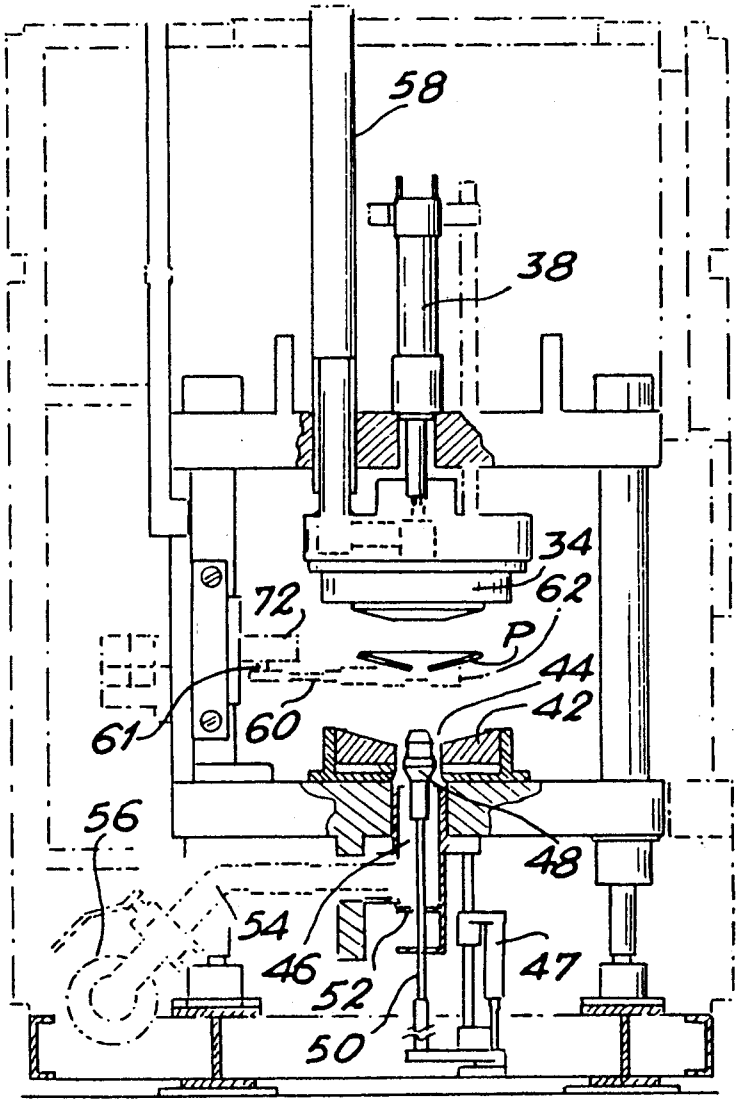
FIG. 4 is a sectional view along IV—IV of FIG. 1.
Figure 3:
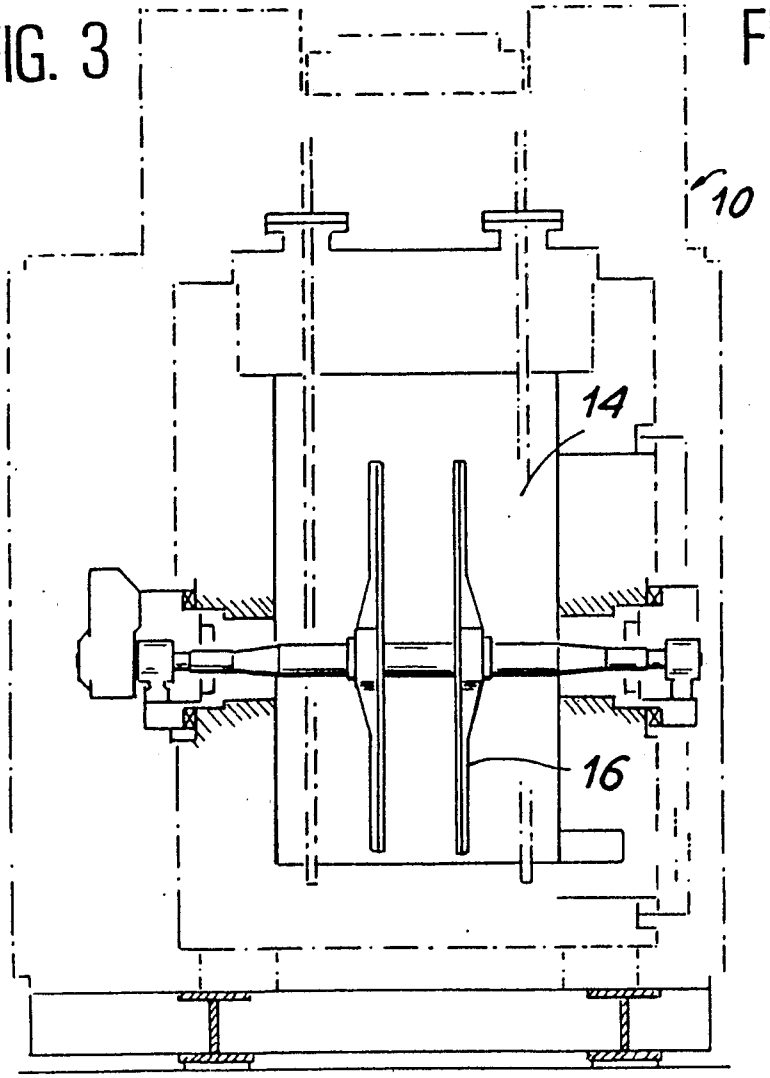
FIG. 3 is a sectional view along III—III of FIG. 1.

In FIG. 4, duct 58 has been shown for the discharge of the hot air from each working station.

The means provided by the invention for ensuring the gripping and displacement, one by one, of the different pieces P from the quenching station 18 up to the conditioning storage and discharge station 30, by passing by each of the various installation treatment stations, will now be described.

Figures 5, 6:
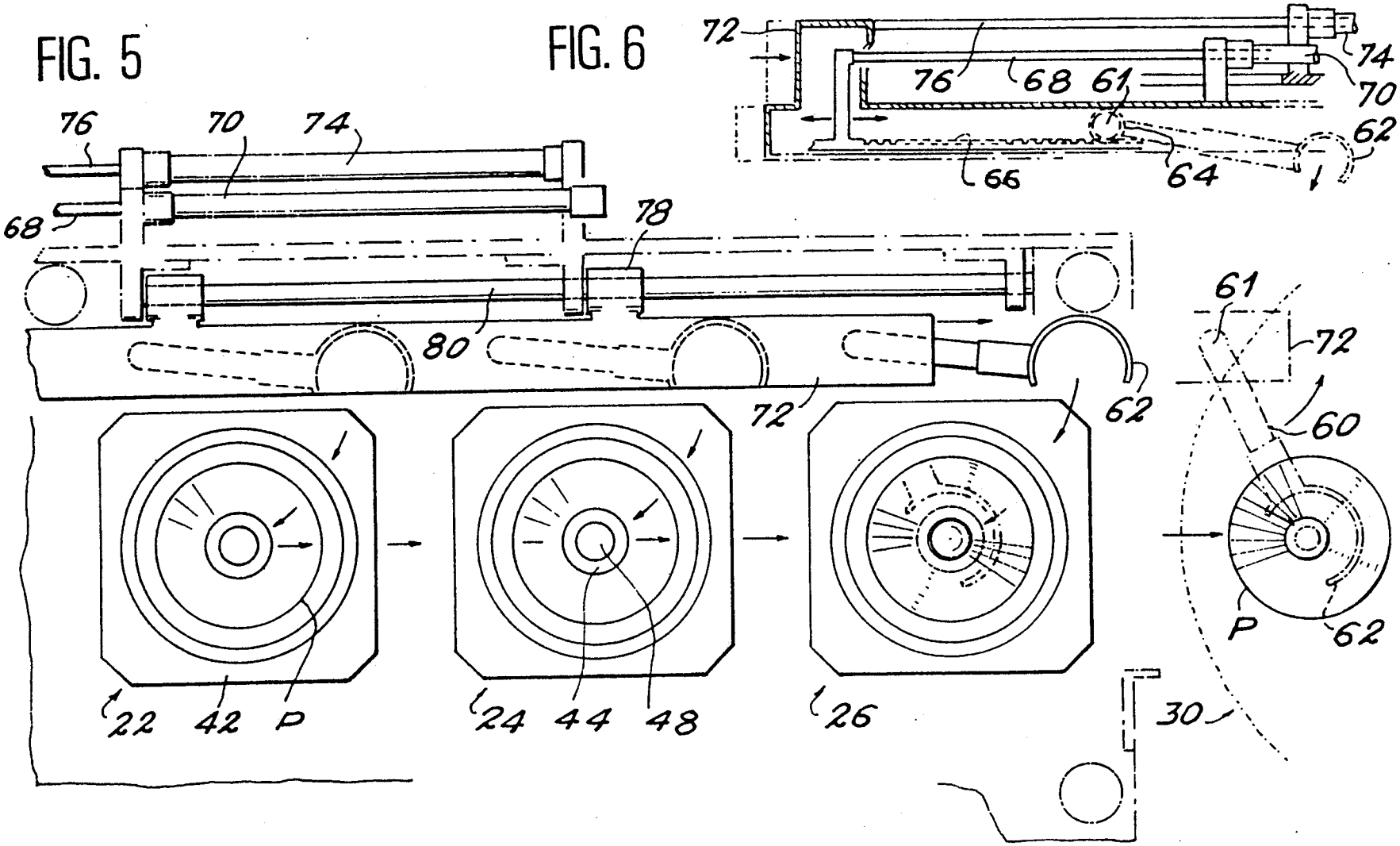
FIG. 5 is a partial view according to a section similar to that of FIG. 2 but at a larger scale so as to show the operation of the system providing for the transfer of the pieces from one working station to another.
FIG. 6 shows at a larger scale a detail of FIG. 5.

These means include gripping arms such as 60, each arm 60 including a support 62 on which the piece P to be displaced comes to bear. Each of the arms is mounted on an axis of rotation such as 61. This axis of rotation includes a pinion 64 (FIG. 6) meshing with a rack 66 which is displaced by rod system 68 via a jack 70. This assembly is mounted inside beam 72 which can be moved longitudinally in translation by a second jack 74 via its control rod 76. Due to this arrangement, the gripping arms 60 can be subjected to a rotary motion about their axis of rotation 61 by the pinion 64 and rack 66 system and the assembly formed by beam 72. The plurality of gripping arms can be imparted with a longitudinal movement in translation according to the displacement axis of the pieces through the installation as will be understood from the description made hereinafter of the operation of this installation, beam 72 being guided during this displacement in relation to slides 78 and guiding rails 80.

The last working station 28 installation in which the treated pieces incoming from the previous stations of peripheral tempering are subjected to a final cooling prior to being transmitted to the conditioning and discharge means 30 will now be described.

This working station which, in FIG. 1, has been denoted generally by reference 28, includes jack 82 on the end of the rod on which is mounted a magnetic plate 84 with a permanent magnet so that this plate may grip the piece coming from the last peripheral tempering station 26. This piece is transferred to plate 84 by the last gripping arm 60 when beam 72 is longitudinally displaced toward the cooling station. The cooling system is made of an air blowing system, the air feed being effected along the axis of plate 84 by a turbine 86.

Prior to the total final cooling in cooling station 28, the pieces in their final state are stored by being stacked on mandrels 88 which are vertically mounted on a rotary plate 90 driven in rotation around its axis 92. Thus, stack L of finished pieces in the discharge station 30 can be discharged by any appropriate means. As may be seen from the drawing, the final cooling station 28 is isolated from the rest of the installation by the presence of a separated enclosure 94. The only passages through the walls of this enclosure are those formed for the introduction of the pieces incoming from station 26 in order to be cooled down, and for the discharge of the stacks of treated pieces during the rotation of plate 90.

The operation of the automatic installation hereinabove described is as follows:

The pieces are formed by hot swaging, then cooled in working stations 14 and 18 which, as hereinabove stated, are described in detail in prior French Patent No. 1,598,224. The cold pieces thus treated and dried are transmitted, one by one, from station 18 to the following working station 20 via the hereinabove described transfer system formed of gripping arms 60 and of the beam device 72 which can be displaced longitudinally. Working station 20 carries out a low temperature tempering, thereby carrying out a de-embrittlement and high hardness preservation treatment. The transfer means thereafter allow transporting the hot piece to the following successive peripheral tempering stations 22, 24 and 26 where the peripheral zones of the pieces are subjected to heat tempering, while the central zones of the pieces are subjected, as hereinabove described, to a blowing of cold air so as to maintain in this central zone the hardness obtained during the low temperature tempering carried out during the working step at station 20. Prior to the transfer operations of the pieces, the latter, as already stated hereinabove, are disengaged on the press tools such as die 42 by extractors 48 which are displaced upwardly by their control rods 50 actuated by their respective jacks while the disk 52 forms a shutter interrupting the blowing of cold air. The pieces, after the last peripheral tempering carried out in working station 26, are transmitted to the cooling station 28, still by the same transfer means hereinabove described (gripping arm 60 and beam 72) and in this cooling station 28 the pieces are subjected to a rapid cooling of all their surfaces so as to retain the acquired hardnesses and to reduce the general temperature of the pieces to a value less than or equal to 70° C. The pieces are then stacked as hereinabove described on mandrel 88, and as soon as the stack is completed, the rotation of plate 90 brings it to the discharge station 30 for being unloaded and conveyed to a transportation station. The cooling station preferably includes a magnetic plate with a permanent magnet, actuated by a jack system for gripping the pieces which are transmitted to this station by the gripping arm, blown cold air being provided for cooling the totality of said piece. The finished pieces incoming from the final cooling station are preferably stacked on vertical mandrels of two magazines placed opposite and spaced apart by 180° on a rotary plate, the rotation of the latter about its axis delivering the stack of finished pieces to the discharge station of the installation.

The successive thermal treatments described above may be executed according to various alternatives while using the same installation. Thus in particular:

a) The pieces incoming from the forming and quenching machine (stations 14 and 18) can be transferred in the hot state to the subsequent treatment stations and these stations can be constructed so as to allow for four progressive tempering steps. It is also possible to carry out a tempering of the whole surface with an identical hardness for the central and peripheral portions without resorting to a cooling down by blowing of the central portion of the pieces being treated. The final rapid cooling of all the surfaces of the pieces is then carried out in station 28, as hereinabove described.

b) The pieces incoming from the forming and quenching machine (stations 14 and 18) can be transferred in the hot state to the subsequent treatment stations where the pieces are subjected to maintenance treatments for a bainitic quenching. Alternatively, a maintenance treatment with a bainitic quenching of the peripheral zone of the pieces can be carried out simultaneously with a cooling of the central portion by blowing cold air as hereinabove described. This quenching by air allows a progressive radial hardness. The final cooling operation is then carried out during step 28 in the hereinabove described manner.

Of course, the installation is completed by hydraulic distribution systems for feeding the various jacks as well as by regulation means allowing control of the heating and cooling temperature values during the various quenching and tempering steps.

The installation according to the invention affords the following advantages:

a possibility of ensuring the heating of the total or partial peripheral zone of the pieces, according to chosen temperatures regulated as requested, which, as already mentioned hereinabove, allows obtaining radially progressive temper and hardness characteristics;

a possibility of grouping in an entirely automated machine a plurality of thermal treatment stations (quenching, maintenance, pretempering, progressive peripheral tempering) which are separated in the installations presently available, and which consequently required separate operators and handling operations;

a possibility of obtaining on the same series of pieces, in a constant and repetitive manner, a quality of treatment which was not obtainable with the traditional techniques used in the machines available and presently on the market.

Of course, the present invention is not limited to the embodiments described hereinabove and it encompasses all the variants thereof. For example:

a preheating equipment prior to the production of the pieces in the oven laboratory provided by conduction or induction;

the heating cell operating by radiation replaced by induction heating;

multiple quenching, forming and tempering stations;

performing quenching at an intermediate temperature, regulated by a heat-conveyor fluid or other means (bainitic 300°/380° C. or discharge at 200° C.); and tempering stations separated from the quenching-forming machine, with or without mechanized synchronization; and so forth.

What is claimed is:

1. An automatic installation for obtaining in series, circular pieces of small thickness, which includes various working treatment stations placed one after the other so that the pieces to be worked are successively transferred from one station to another, which comprises:

a) an automatic machine for hot swaging and quenching of circular pieces;

b) transfer means wherein the pieces are extracted by an extractor from the swaging and quenching automatic machine and transferred one by one to the various working stations, with the assistance of gripping arms including piece receiving plates, said arms being imparted with a rotary motion and with a translation motion with the assistance of a mobile beam and jacks system, said extractor transferring pieces to said transferring means when said extractor is in a high position;

c) said automatic installation containing working stations having a press provided with individual heating means, said working stations receiving the pieces one by one with the assistance of the transfer means and withdrawing the pieces to be treated from the quenching stations of the automatic machine for transferring them successively thereafter to each of the working stations;

d) each working station is provided in the form of a press including a die and a punch, each press being provided with an individual heating means and the piece being able to be clamped in the press, the die being formed with a bore in its central portion, said bore being in correspondence with a duct for passing cold air on to the central portion of the pieces placed in the die, said extractor being movable within said bore to said high position;

e) means for tempering each piece by blowing into each working station cold air in the central portion of the piece placed on a corresponding press, so as to maintain the temperature of this central portion at less than the temperature of the periphery of the pieces, means associated with said extractor to interrupt feeding of the cold air when said extractor is in said high position;

f) a final cooling station on which the incoming piece from the preceding work station is subjected to a cooling by being blown with cold air; and g) means for storing the treated pieces by stacking them so as to ensure thereafter the discharge of the treated pieces conditioned in stacks.

2. An installation according to claim 1, wherein pre-tempering is carried out in a first work treatment station and a series of peripheral tempering operations are carried out in following successive work treatment stations, said central portion of the treated piece being constantly cooled during said peripheral tempering operations.

3. An installation according to claim 1, wherein each of the arms is mounted on an axis of rotation, said axis of rotation including an assembly comprising a pinion meshing with a rack displaced by a first jack, said assembly being mounted on said mobile beam, which is displaced in longitudinal translation by said jack.

4. An installation according to claim 1, wherein the automatic machine for forming by hot swaging and quenching the circular pieces includes means for delivering, one by one, said circular pieces to a heating enclosure where the pieces are admitted in successive compartments of a barrel, said enclosure providing for the heating of the pieces which are then delivered, one by one, by the barrel to a quenching station provided in the form of a press, said punch and die being cooled by circulation of a fluid.

5. An installation according to claim 1, wherein each press die is provided with said extractor, said extractor adapted to slide inside said bore under the action of a control rod actuated by a jack, said extractor, at the end of the treatment, lifting the piece so that the piece can be transferred to said gripping arms.

6. An installation according to claim 5, wherein said control rod of each respective extractor is provided with a circular disk forming a shutter, said shutter interrupting the feed of cooling air to the press plate when the extractor is in said high position.

7. An installation according to claim 1, wherein said final cooling station includes a magnetic plate having a permanent magnet, said magnetic plate being actuated by a jack system allowing gripping the pieces which are transmitted to said final station by said gripping arms, blown cold air being provided for cooling the totality of said piece.

8. An installation according to claim 1, wherein finished pieces from said final cooling station are stacked on vertical mandrels of two magazines placed opposite and spaced apart by 180° on a rotary plate, the rotation of said rotary plate about its axis allowing delivering the stack of finished pieces to a discharge station of the installation.

9. The installation according to claim 1, wherein said circular pieces are spring diaphragms.

10. An automatic installation for tempering spring diaphragms, which comprises:

a) means for heat treating the spring diaphragms;

b) automatic means for transferring the heated spring diaphragms to working stations;

c) each working station including a press provided with individual heating means, said working stations receiving the pieces, one by one, automatically, for transferring the spring diaphragms successively to additional working stations;

d) each working station is provided in the form of a press including a die and a punch, and the die being formed with a bore in its central portion, said bore being in correspondence with a duct of cold air for cooling down the central portion of the spring diaphragms placed in the die, an extractor moveable within said bore to transfer spring diaphragms to said means for transferring when said extractor is in a high position, means associated with said extractor to interrupt the cold air, when said extractor is in said high position; and e) cooling means for cooling the spring diaphragms prior to their being discharged from the installation.

11. An installation according to claim 9, wherein said extractor is moved by a jack, said jack including a control rod connected to said extractor.

12. An installation according to claim 10, comprising a shutter on said control rod, said shutter interrupting the flow of cold air through said bore when said extractor is in said high position.

* * * * *